United States Patent [19]

Martinez Gimeno

[11] Patent Number: 5,029,370

[45] Date of Patent: Jul. 9, 1991

[54] SHOE CLOSURE

[76] Inventor: Carlos V. Martinez Gimeno, Lorenzo Carbonell, 71, 03003 Alicante, Spain

[21] Appl. No.: 114,931

[22] Filed: Oct. 30, 1987

[30] Foreign Application Priority Data

Oct. 22, 1986 [ES] Spain ..... 8602762

[51] Int. Cl.[5] ..... A43C 7/00

[52] U.S. Cl. ..... 24/712.5; 24/712.6; 24/712.9

[58] Field of Search ..... 24/117 R, 120, 121, 24/147, 712.2, 712.5, 712.6, 712.7, 712.8, 712.9, 132 R

[56] References Cited

U.S. PATENT DOCUMENTS

| | | | |
|---|---|---|---|
| 303,549 | 8/1884 | Snyder | 24/120 |
| 667,175 | 2/1901 | Atkinson | 24/117 R |
| 670,561 | 3/1901 | Hoegemann | 24/120 |
| 674,494 | 5/1901 | Brott | 24/120 |
| 1,018,557 | 2/1912 | Franz | 24/121 |
| 1,146,934 | 7/1915 | Gleeson | 24/121 |
| 1,481,903 | 1/1924 | Hart | 24/712.6 |
| 3,057,029 | 10/1962 | Miller, Jr. et al. | 24/120 |
| 3,225,402 | 12/1965 | Altman et al. | 24/120 |
| 3,290,745 | 12/1966 | Maxwell et al. | 24/120 |
| 3,345,707 | 10/1967 | Rita | 24/120 |
| 4,680,835 | 7/1987 | Horng | 24/712.5 |

FOREIGN PATENT DOCUMENTS

| | | | |
|---|---|---|---|
| 355377 | 8/1961 | Switzerland | 24/120 |

*Primary Examiner*—Victor N. Sakran
*Attorney, Agent, or Firm*—Kuhn and Muller

[57] ABSTRACT

A clasp for laces is composed of two pivotally joined elements which work together as a clasp or clip on the laces. The elements have been provided with openings for the ends of the laces and a point of union with an outlet for the remaining parts of the laces. The moveable pieces are biased to an open clamping position. In a preferred embodiment, the movable pieces are articulated obliquely so that they present a lower concave surface to fit over the curve of the shoe upper.

12 Claims, 2 Drawing Sheets

FIG. 1A
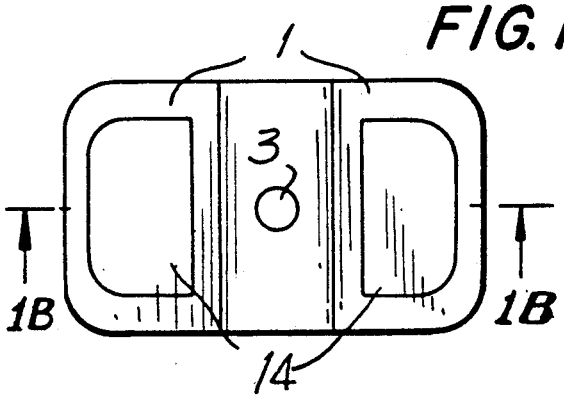
FIG. 1C
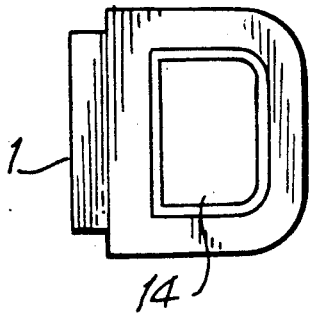
FIG. 1B
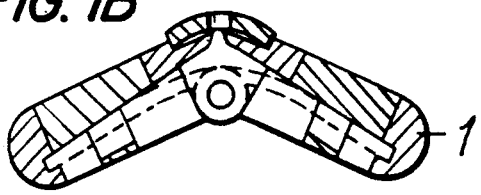
FIG. 1D
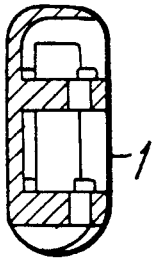
FIG. 2
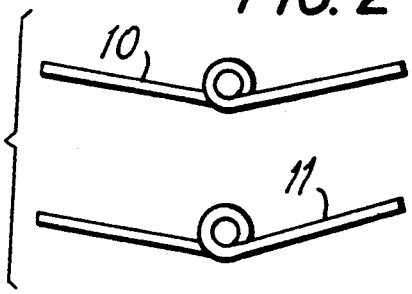
FIG. 1E
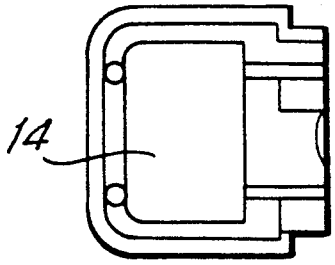
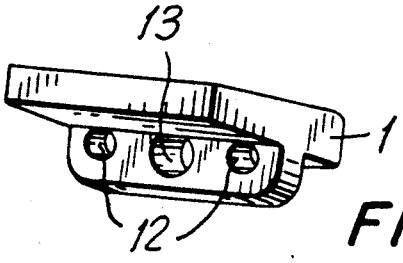
FIG. 6

FIG. 1F
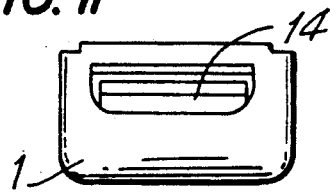
FIG. 1G
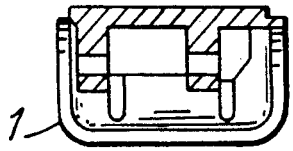
FIG. 4A
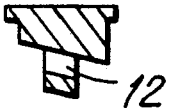
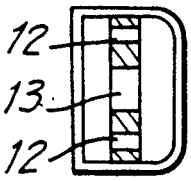
FIG. 4B
FIG. 3A
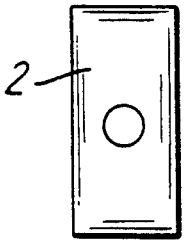
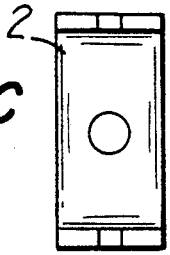
FIG. 3C
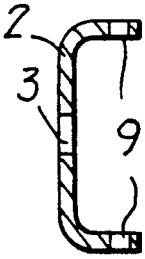
FIG. 3B
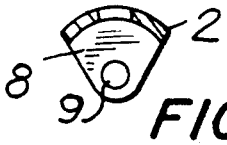
FIG. 3D
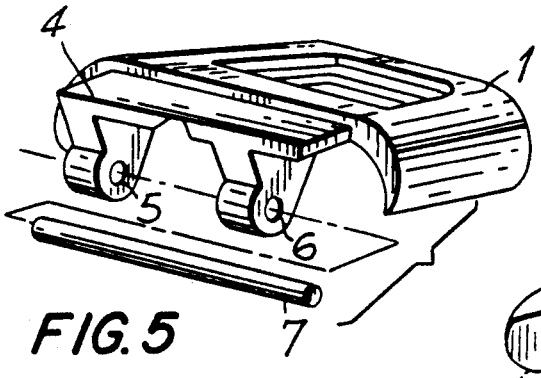
FIG. 5
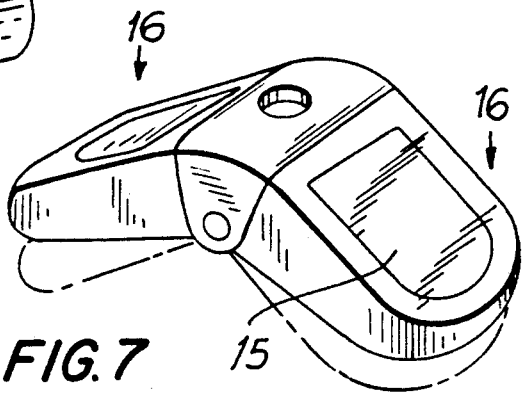
FIG. 7

SHOE CLOSURE

FIELD OF THE INVENTION

The invention relates to novelty items and in particular to shoelace clasps which may be substituted for tide loops to secure the laces of the shoe or the like.

BACKGROUND OF THE INVENTION

In lace shoes, it is necessary for correct attachment to the foot of the wearer to have a loop or similar item at the ends of the laces.

This operation which in principle would seem to be trivial is not so for inexpert wearers, such as children, old or physically handicapped people.

Furthermore, the disadvantage in the use is that these loops become loose or even open up completely, especially if the laces are of silk or nylon, with the resulting inconvenience, and the risk of falling when stepping on loose laces.

There are shoes on the market with simple and safe closing devices, but they are all based on the elimination of shoelaces. For various reasons, including fashion and design, it is still necessary to make lace shoes.

It is the purpose of the invention to develop a device of the type indicated which will avoid the above listed difficulties.

SUMMARY OF THE INVENTION

According to the invention, the foregoing objectives are attained because the device includes:

A support for attachment to the upper of the shoe composed of two basic pieces jointed together which catch the laces like a pincer or clip. They have openings for the ends of the laces, and a joint with an outlet for the laces.

Other advantages and characteristics of the invention will become clear from the following description aided by the attached drawings, which are only examples; the invention is not limited to these versions.

BRIEF DESCRIPTION OF THE DRAWINGS

FIG. 1A is a top plan view of a shoe closure in accordance with the present invention.

FIG. 1B is a cross-sectional view taken along line 1B—1B in FIG. 1A;

FIG. 1C is a plan view of the right element, part broken away, of the shoe closure of FIG. 1A;

FIG. 1D is a bottom view, part broken away, of the right element of the shoe closure shown in FIG. 1C;

FIG. 1E is a bottom view, part broken away, of the left element of the shoe closure shown in FIG. 1A;

FIG. 1F is a perspective view of the shoe closure element shown in FIG. 1C;

FIG. 1G is a side view of the shoe closure element shown in FIG. 1F;

FIG. 2 shows the resilient elements tending to bias the shoe closure of the present invention to its open position;

FIGS. 3A to 3D are a group of projections showing the top of the bridge element of the shoe closure of FIG. 1A and the bottom side and end thereof in cross-section;

FIGS. 4A and 4B are cross-sectional views of a dependent guide promontory for guiding the shoelaces;

FIG. 5 is a perspective view of one movable element or piece of the shoe closure of the invention.

FIG. 6 shows a detail of one of the basic components of the device.

FIG. 7 illustrates a view in perspective of the device with the dotted line showing how it operates.

BRIEF DESCRIPTION OF THE PREFERRED EMBODIMENTS

The device is composed a pair of basic pieces 1, pivotally interconnected and mounted on a bridge 2, in which a central opening 3 is arranged as an outlet for the shoelaces.

Each of the laterally pieces terminated a protruding portion 4 (FIG. 5) which, as will be explained below in detail, project toward each other in the assembled device and constitute the means for holding the shoelaces. From each of these protruding portions 4, pairs of spaced apart lugs 5 with holes 6 depend perpendicularly downward.

The depending lugs 5 on each of the protruding portions are spaced such that when the clasp is assembled the lugs interfit together on a common pivot axis defined by a pair of axles 7 which extend through the holes 6 formed in respective adjacent pairs of the lugs 5. The bridge 2 is shaped into depending lateral fins 8 with openings 9.

The openings 9 are aligned with the openings 6 in the depending lugs and each opening is mounted on one of the common axles 7. In this way the pieces 1 may pivot downward and away from each other to open a gap between the protruding portions 4. In addition, on axle 7 are mounted springs 10 and 11, whose triggers are connected on openings 12 provided in the lower part of pieces 1. Furthermore, each of these pieces 1 has another opening 13 near opening 12, to pull the laces through.

In addition, pieces 1 contain cuts of material 14 to connect an ornamental closing 15.

As can be seen clearly from FIG. 7, to control the laces one presses on pieces 1 in the direction marked by the arrows 16, so that the said pieces 1 tilt down (as shown by the dotted line) causing a gap or a slit to form between the lateral protruding portions 4 through which the ends of the shoe laces can be passed, which can then be taken out through outlet 3. The laces are stopped by merely relaxing the pressure illustrated by the above mentioned arrows 16, as the springs will push the basic pieces 1 into their original position, thereby retaining the laces . To release the closing, it is only necessary to press pieces 1 down in the direction indicated by arrows 16 and at the same time separate the device from the shoe upper.

As this patent has now been sufficiently described, as merely an example of the many versions which it can assume on the basis of its construction described in this paper, we wish to point out that the changes in form, size, materials used and other superficial changes must not be considered variations which affect the essential nature of the device.

I claim:

1. A clasp for laces comprising:

a pair of grip members pivotally interconnected so as to pivot towards each other from a fixed relatively open position;

means biasing said members to said open position;

clamping elements formed on said grip members adjacent the pivot axis thereof, said clamping elements abutting each other in said open position and defining a gap therebetween when said grip members are pivoted toward each other; and means guiding the laces through said gap whereby the laces are clamped in said open position and unclamped when said grip members are pivoted toward each other.

2. The clasp of claim 1 in which said guiding means comprises a bridge member pivotally engageable on said pivot axis with each of said grip members.

3. The clasp of claim 2 in which said bridge member is provided with an opening through which the laces are passed.

4. The clasp of claim 3 in which said guiding means comprises, in addition, a depending member protruding from the undersurface of each of said grip members and having at least one aperture in a plane substantially parallel to said pivot axis through which the laces are passed.

5. The clasp of claim 1 in which said grip members are oriented substantially obliquely to each other in said open position.

6. The clasp of claim 1 comprising stop means for limiting the movement of said grip members toward each other about said pivot axis.

7. The clasp of claim 1 in which the undersurface of each of said grip members defines a recessed area for containing the laces.

8. The clasp of claim 7 in which said biasing means comprises at least one spring element situated within said recessed area.

9. The clasp of cl aim 1 in which the outer surface of each of said grip members is provided with tactile indicia to facilitate operation of the clasp.

10. The claps of claim 9 in which said tactile indicia include a recessed portion for displaying printed matter or the like.

11. A clasp for laces according to claim 1 characterized by the fact that said clamping elements consist of two lateral extensions formed at the ends of said grip members so that the laces are caught and held between them.

12. The clasp for laces according to claim 1 characterized by the fact that said grip members are arranged obliquely so as to offer below a concave shell to fit the curvature of the shoe.

* * * * *